US005678693A

United States Patent [19]

Tapp et al.

[11] Patent Number: 5,678,693

[45] Date of Patent: Oct. 21, 1997

[54] GLASS STORAGE SAFE

[75] Inventors: Dale D. Tapp, Iuka, Miss.; Al T. Horton, Florence, Ala.

[73] Assignee: Dale Tapp, Muscle Shoals, Ala.

[21] Appl. No.: 686,726

[22] Filed: Jul. 26, 1996

[51] Int. Cl.[6] ..... B65D 85/48

[52] U.S. Cl. ..... 206/454; 220/331; 220/335; 312/290

[58] Field of Search ..... 206/454, 372, 206/373; 220/335, 331, 346; 190/24, 112, 113; 312/284, 290, 319.2

[56] References Cited

U.S. PATENT DOCUMENTS

| | | | |
|---|---|---|---|
| 1,661,121 | 2/1928 | Huson | 206/372 |
| 1,861,520 | 6/1932 | Arnold | 312/290 |
| 2,268,199 | 12/1941 | Greer . | |
| 3,092,428 | 6/1963 | Kerschner | 206/373 |
| 3,809,234 | 5/1974 | Kurick . | |
| 4,383,721 | 5/1983 | Knaack et al. | 312/290 |
| 4,585,266 | 4/1986 | Steinberg | 220/331 |
| 4,768,652 | 9/1988 | Fallon | 206/373 |
| 4,936,454 | 6/1990 | Wang | 220/335 |
| 5,269,422 | 12/1993 | Chevrette | 206/454 |
| 5,269,599 | 12/1993 | Moring | 312/290 |
| 5,465,883 | 11/1995 | Woodward . | |
| 5,547,080 | 8/1996 | Klimas | 206/373 |

*Primary Examiner*—David T. Fidei

*Attorney, Agent, or Firm*—Laurence R. Brown

[57] ABSTRACT

A receptacle storage box ideally suited as a night storage safe for receiving, isolating and storing windshields has a front panel flap hinged to the front of a top lid hinged at the back, and an accompanying fail-safe stop mechanism for holding the lid and flap in a stable open access position. Thus, the lid provides easy to grasp and raise structure which locks into the open access position out of the way to permit a low front threshold over which windshields are lifted for storage in an internal rack exposed by the access opening encompassing both the front flap opening area and a top lid opening area. Advantages are provided of an easy and safe manual opening characteristic with lid resident in a fail-safe locked-in-place position presenting a large top and front work window area for entry of a windshield into the box over a low threshold front panel member.

9 Claims, 1 Drawing Sheet

GLASS STORAGE SAFE

1. Technical Field

This invention relates to glass storage racks and more particularly it relates to deposit boxes known as storage safes for receipt and overnight storage of glass panels including automobile windshields.

2. Background Art

Broken automobile windshields, usually repaired by local shops, come in so many different models and styles that they cannot be stocked at every shop. Thus, the local shops must order the proper windshield for local delivery from the factory or a factory distributor that can stock a large variety of windshields. By convention, overnight delivery is made to the local shop premises so that next-day installation can be arranged. At the local shops therefore a locked glass container or glass storage safe is accessible for such overnight delivery.

These safes may be in cramped quarters, and not in well lighted spots or those with optimum working conditions. That is critical in view of the size and awkwardness of handling an automobile windshield in a modern car. The safety of the delivery person is at stake in the manual stress of opening the box and handling the windshields as well as the need to avoid damage to the windshields, or accompanying moldings therefor which are conventionally delivered with the windshields.

The glass boxes of the prior art conventionally have a set of racks for receiving and storing several glass articles separately held in corresponding spaced slots in a four walled chest with a hinged top access door. This introduces significant problems under the conventional working conditions of the delivery and subsequent removal of the glass articles from the safe. For example, it is awkward, dangerous and physically challenging to lift a glass over a high sidewall to deposit in a proper slot on the bottom of the chest, particularly in the night time environment where visibility is poor, etc. In this process an article of glass can easily be dropped, scratched or otherwise damaged.

Added to this inconvenience and danger is the problem of manipulating the lid. Even if the lid is held open by a suitable lock or mechanism, they are subject to inadvertent manipulation or setting and mechanical failure. And the storage boxes are so large that the lids are heavy and extend high enough that they cannot be conveniently or safely grasped and handled, even to open without trying to deliver a piece of glass simultaneously. Furthermore the inherent tendency toward carelessness and lack of sufficient training of the delivery persons contributes to the potential of disaster. To better visualize these problems review of the construction of the toy chest of U.S. Pat. No. 2,268,199 to M. B. Greer, Dec. 30, 1941, will reveal a hinged lid panel that attains a very unstable open position and which cannot be stably left in a partially opened position without manual support of a delivery person that would interfere with the transfer of a windshield into a large dimensioned storage safe.

It is therefore a primary objective of this invention to improve the art of storage containers, particularly glass safes by introducing safe, simple and improved operation and structure.

Other objects, features and advantages of the invention will be found throughout the following description, claims and accompanying drawings.

DISCLOSURE OF THE INVENTION

The significant structural change this invention makes to the conventional glass safe lies in the construction and operation of the lid in a manner that the deliverer need not raise the glass over a high entrygate into the safe. Thus the front panel of .the glass receiving chest is provided with an intermediate seam and an upper flap that is hinged to the upper lid, so that a lowered threshold is provided over which the glass articles must be lifted to enter a slot in the storage chest.

Also the access window for placing the windshields in the storage racks is enlarged by hinging the flap to a lid panel which permits access also through substantially the entire top portion of the chest.

The front flap is further structured as a safety member which is easily grasped and moved upwardly without extending the arms above a comfortable working level. Also it may be quickly and uncritically may be moved upwardly and stored into a fail-safe position while hinged to the top lid panel of the chest. The lid assembly becomes in effect an inherently self-operating safety latch that prevents the lid mechanism from failing and for positioning the lid assembly so that it cannot interfere with the glass storage procedure.

Furthermore the flap is conveniently grasped to lift the lid from a comfortable position affording a mechanical advantage in lifting the lid without outstretching the arms to the limit, thereby significantly reducing the dangers of injury to the delivery person.

THE PREFERRED EMBODIMENT

Figure 1:
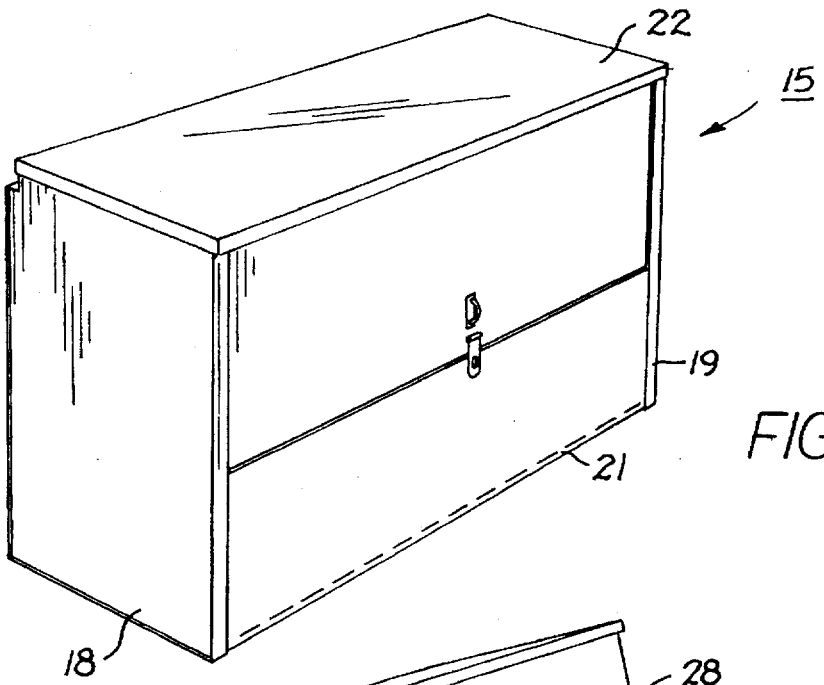
FIGS. 1 to 3 show the glass safe structure of this invention in perspective respectively in closed, partly open and glass receiving states.
Figure 2:
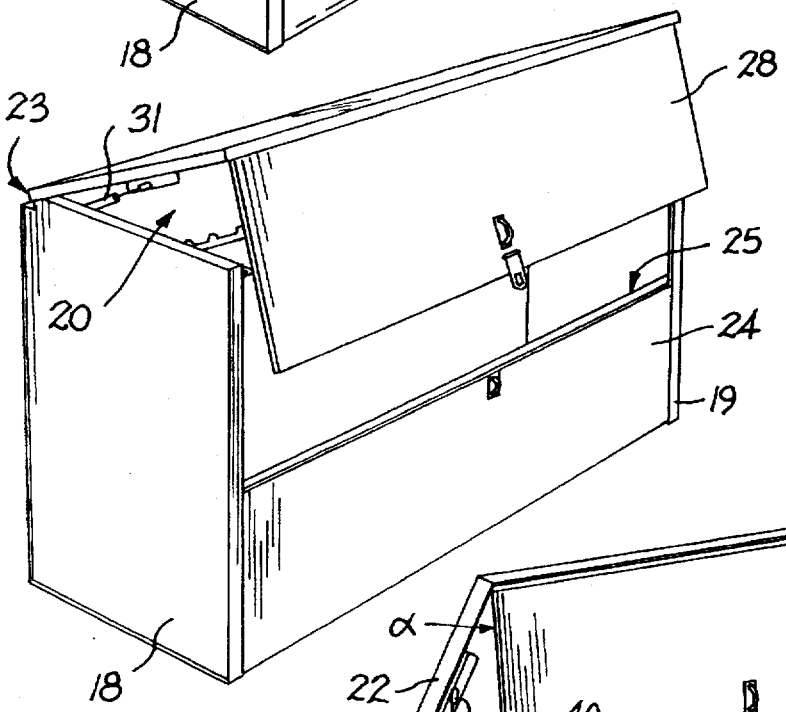
Figure 3:
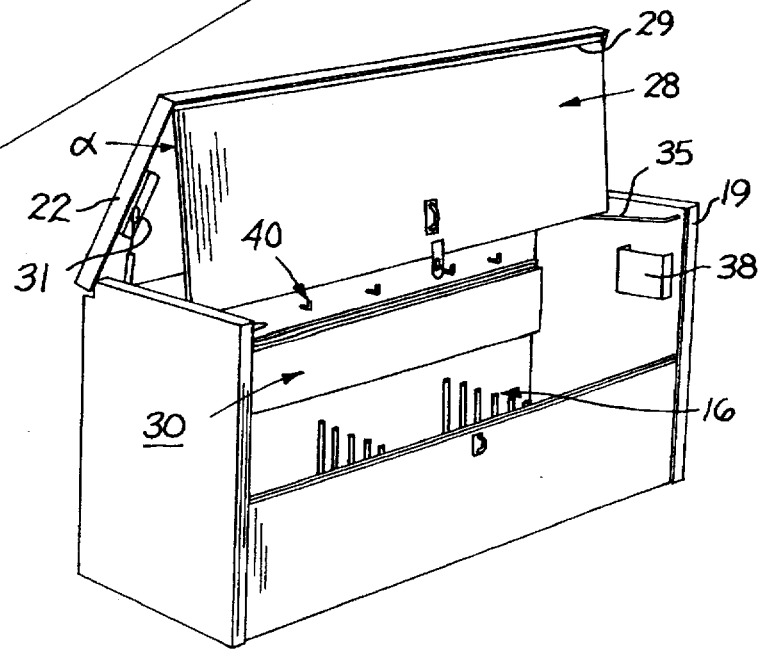

With reference to FIGS. 1 to 3, the receptacle storage box or chest 15 is seen to be ideally suited as a night storage safe for receiving, isolating and storing windshields. The chest 15 is preferably a parallelepiped of sufficient size to store therein windshields (not shown) in the racks 16, and thus stands with a top lid about hip high for the usual delivery person and with a front-rear depth of perhaps three feet. The internal racks 16 for storage of windshields are well known in the art as seen for example from U.S. Pat. Nos. 3,809,234 to J. F. Kurick, May 7, 1974 and 5,465,883 to J. A. Woodward, Nov. 14, 1995, and thus are not shown in detail.

This chest 15 is preferably formed of seven panels, preferably of formed sheet aluminum, namely: two end panels 18, 19; a rear panel 20, a bottom panel 21, a top lid 22 hinged 23 at the rear, a fixed-in-place lower front panel 24 having the threshold 25, and the movable front flap panel 28 hinged 29 at the top to the front edge of the top lid 22.

The opening system of lid 22 and flap 23, as shown in FIG. 3, stores in a stable open access position with the lid 22 and flap 28 defining therebetween an acute angle alpha and providing a large unimpeded working space 30 for entry and removal of windshields. That reduces likelihood of strain to the delivery person or damage to the windshield. Furthermore, the lid system 22, 28, 29 provides easy to grasp and raise structure which uncritically self-locks into the open access position such as shown, which is out of the way and presents a low front threshold over which windshields need be lifted for storage into the internal rack 16. The top lid may be optionally fitted with a conventional hydraulic brake mechanism 31 for retaining the weight of the lid assembly in an open access state.

Note that the flap panel 22 fits inside the end panels 18, 19, so that there is no interference in opening the lid assembly, and so that the flap 28 can serve as a self operating stable stop that rests upon brackets 35 disposed internally on each end panel 18, 19. The brackets 35 slant downwardly from front to back so that any tendency for the assembly to become dislodged and move from a stable stop position due to vibration on the box 21 or by being accidentally brushed, for example, could result only in a wider opening of the lid assembly.

Other accessories contained in the chest include the document or paper receiving pocket 38 affixed inside end panel 19 and the set of fixtures for arraying the moldings that are normally delivered for custom fit with the respective windshields to be neatly arrayed in a damage free position.

Having therefore introduced a novel and improved glass safe those features of novelty setting forth the spirit and nature of the invention are set forth with particularity in the following claims.

We claim:

1. A deposit box for glass articles such as windshields, comprising in combination:

a substantially parallelpiped chest formed by quadrilateral outer panel members having a rectangular bottom panel upon which it rests;

a rack for receipt, isolation and storage of a plurality of glass windshields arranged on the chest bottom panel;

an access opening system formed of movable outer chest panel members comprising a flap panel providing access from a front portion of chest to the rack for inserting and removing said windshields, said opening system providing closure in a stable state to adapt the chest into said deposit box;

said outer chest panel members further comprising a rectangular lid panel hinged to a rear chest wall panel to pivot upwardly at a back edge of the lid, said flap panel being hinged at a front edge of the lid to move away from the front portion of the rack and pivot inwardly towards the lid panel when the lid panel is pivoted upwardly, thereby raising the flap panel away from the front of the said closure state to produce an access opening permitting movement of a windshield into and out of the box and retention means for stably holding the lid panel and flap panel as a unit in an open position with an acute angle therebetween.

2. The deposit box defined in claim 1 wherein said flap panel is dimensioned to fit within two opposite chest end panels.

3. The deposit box defined in claim 1 further comprising within said chest a set of fittings for receiving windshield molding members in an ordered protective array.

4. The deposit box defined in claim 1 further comprising within said chest affixed to one end panel a pocket for receiving documents and papers.

5. The deposit box defined in claim 1 wherein the lid and flap are constructed of aluminum.

6. The deposit box defined in claim 1 further comprising a hydraulic braking mechanism for retaining the weight of the lid stably in a partly opened condition.

7. A storage chest, comprising in combination, seven panels forming a substantially closed storage chest, comprising: two end panels, a bottom panel, a back panel hinged at the top, a hinged at the rear top panel, a front closure-opening system having a fixed-in-place bottom front panel portion, an upper movable flap opening portion hinged at the front of the top panel and dimensioned to fit inside the two end panels, a mechanism for keeping the top panel hinged in an open state to permit access inside the storage chest comprising a set of retainer members within the chest on opposite end panels for intercepting the bottom edge of the flap opening portion when hinged to the top panel to hold the top panel and flap panel open with an acute angle defined therebetween.

8. The storage chest defined in claim 7 further comprising a rack array arranged inside the chest on the bottom panel for storage of a plurality of automobile windshields in a position to be inserted and removed from the front of the storage chest with the top panel and flap panel in the open state with the acute angle defined therebetween whereby the chest lid may be safely opened to the open position and closed within comfortable reach of a person handling the windshields.

9. A storage cabinet, comprising in combination, a closed storage box having an opening mechanism comprising a hinged top lid having a front flap panel hinged thereto, and at least one end bracket positioned within the storage box for engaging said front flat panel thereby frictionally holding the opening mechanism by gravity in a fail-safe open position with the lid and front flap panel defining therebetween an acute angle.

* * * * *